US010525703B2

(12) United States Patent
Gracia Verdugo et al.

(10) Patent No.: US 10,525,703 B2
(45) Date of Patent: Jan. 7, 2020

(54) DROP DETECTION

(71) Applicant: HEWLETT-PACKARD DEVELOPMENT COMPANY, L.P., Houston, TX (US)

(72) Inventors: Antonio Gracia Verdugo, Barcelona (ES); Mauricio Seras Franzoso, Sant Cugat del Valles (ES); Joan Jorba Closa, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/748,141

(22) PCT Filed: Oct. 23, 2015

(86) PCT No.: PCT/EP2015/074586
§ 371 (c)(1),
(2) Date: Jan. 26, 2018

(87) PCT Pub. No.: WO2017/067603
PCT Pub. Date: Apr. 27, 2017

(65) Prior Publication Data

US 2018/0222182 A1 Aug. 9, 2018

(51) Int. Cl.
*B41J 2/045* (2006.01)
*B41J 2/12* (2006.01)

(52) U.S. Cl.
CPC ..... *B41J 2/04561* (2013.01); *B41J 2/0456* (2013.01); *B41J 2/04505* (2013.01); *B41J 2/04508* (2013.01); *B41J 2/04558* (2013.01); *B41J 2/12* (2013.01)

(58) Field of Classification Search
CPC ..... B41J 2/04561; B41J 2/04505; B41J 2/04508; B41J 2/165; B41J 2/16579; B41J 2/0451
See application file for complete search history.

(56) References Cited

U.S. PATENT DOCUMENTS 5,170,177 A 12/1992 Stanley
6,764,156 B2 7/2004 Mantell
8,974,037 B2 3/2015 Nakano
(Continued)

OTHER PUBLICATIONS

Cibis et al; "Optimization of a DOD Print Head Signal for the Ink-Jetting of Conductive Circuits"; NIP & Digital Fabrication Conference; Jun. 24, 2008.

*Primary Examiner* — Jason S Uhlenhake
(74) *Attorney, Agent, or Firm* — HP Inc. Patent Department

(57) ABSTRACT

Herein is described a method involving a drop detector. The method may comprise: ejecting ink drops from the nozzles on a printhead toward a drop detector. A drop characteristic may then be determined from the drop detector for each ink-jet nozzle. Drop characteristics for the nozzles across the printhead may be collated into a data set, and compared with a predetermined data set for a printhead having predetermined print behaviour to determine if and how the data sets differ in terms of the pattern of drop characteristics across the printheads. If the data sets differ, a recovery strategy may be selected based how the data sets differ in terms of the pattern of drop characteristics across the printheads. A system and computer readable medium are also described herein.

20 Claims, 7 Drawing Sheets

(56) References Cited

U.S. PATENT DOCUMENTS

| | | | | |
|---|---|---|---|---|
| 2003/0081040 | A1 | 5/2003 | Therien et al. | |
| 2007/0070099 | A1 | 3/2007 | Beer et al. | |
| 2008/0211849 | A1 | 9/2008 | Pierik | |
| 2008/0225072 | A1* | 9/2008 | Klees | B41J 2/125<br>347/19 |
| 2010/0302301 | A1 | 12/2010 | Yuhei et al. | |
| 2011/0279551 | A1* | 11/2011 | Lee | B41J 2/14233<br>347/68 |
| 2013/0016147 | A1* | 1/2013 | Cardells Tormo | B41J 2/175<br>347/14 |
| 2014/0035981 | A1* | 2/2014 | Burress | B41J 2/04581<br>347/14 |

* cited by examiner

DROP DETECTION

BACKGROUND

An inkjet printing device is a fluid ejection device that provides drop-on-demand ejection of fluid droplets through printhead nozzles so as to print images onto a print medium, such as a sheet of paper. Sometimes, characteristics of ink drops ejected by an inkjet printer may be detected. Characteristics of the ink drops may be used to assess the state or "health" of structural and operational features of the printer.

DETAILED DESCRIPTION

Examples in the present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that at least some of the flow and/or block in the flow charts and/or block diagrams, as well as combinations of the flows and/or diagrams in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operation steps to produce computer-implemented processing, thus the instructions executed on the computer or other programmable devices provide a step for realizing functions specified by flow(s) in the flow charts and/or block(s) in the block diagrams.

Figure 2A:
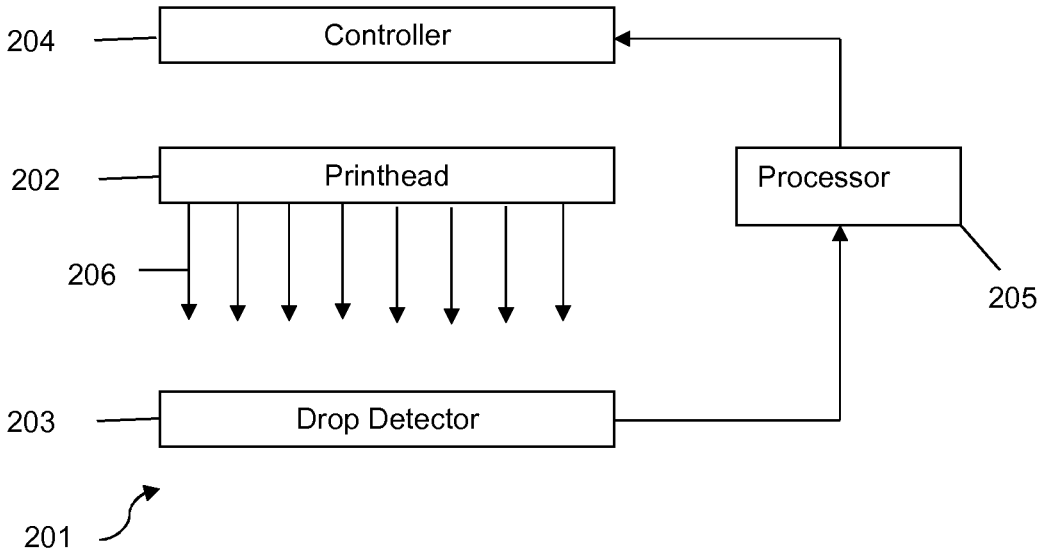
FIG. 2A shows schematically an example of a system as described herein and FIG. 2B shows an example of a processor and an associated memory, which may form part of the system
Figure 2B:
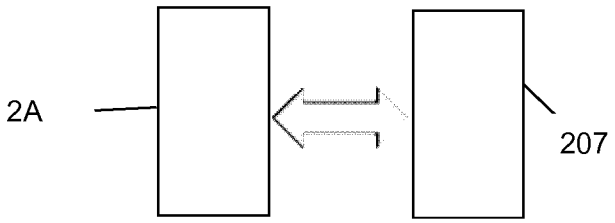

Further, the teachings herein may be implemented in the form of or using a computer software product, the computer software product being stored in a storage medium and comprising a plurality of instructions for making a computer device implement the methods recited in the examples of the present disclosure. As illustrated schematically in FIG. 2B, a processor (2A) may be used, which could provide the processor (205) in FIG. 2A, associated with a memory 207. The memory may be any computer readable storage medium and may store computer readable instructions, which may be executed by the memory.

The quality of a printed image may depend on a number of factors. One of these factors is the ejection behaviour of the nozzles on a printhead. For instances, in one example, in a printer operating as expected, with all nozzles firing drops at the correct time and with the correct velocity, drops fired from the nozzles should land on a print substrate in an expected location. Image quality can deteriorate, however, when the ejection behaviour is not as expected. Nozzles may not eject drops in the expected manner for a number of reasons. It may be due to kogation, i.e. the deposition of solid material in a nozzle, e.g. over the resistors, or another fault, such as the mechanical or electrical faults in the nozzle or associated components. Kogation of a nozzle can vary in its severity. Mild kogation may result in a change in the way a drop is ejected (e.g. a decrease in momentum, indicated by, for example, a decrease in drop velocity or mass of the drop). Severe kogation may result in the nozzle not being able to eject a drop at all, or at least not to the print substrate. Some previous drop detection methods have looked at whether or not a drop is detected at all, i.e. only being able to detect severe kogation. Recovery strategies at this point are limited, although previous solutions have included using other nozzles as back-up for nozzles that fail.

Kogation has been noticed in the usage of ramps, when printing swathes are often used. Sometimes such printing methods employ nozzles toward the ends of a printhead less than the nozzles toward the centre of the printhead to have smoother transitions at the swathe boundaries. With the different levels of usage of the nozzles across the printhead, differing levels of kogation can occur across the nozzles of a printhead, and therefore different drop velocities can be observed across the nozzles of the printhead. The drop velocity may be difficult to compensate using some recovery methods. For example, in some circumstances, printhead alignment and/or servicing routines, may not result in improved print behaviour. Altering the printhead alignment can, in some circumstances, be counterproductive.

Examples of the methods and system described herein may be used to detect unusual print behaviour at an early stage, e.g. before severe kogation has occurred, and allow for appropriate action to be taken to return the print behaviour to normal. It may be used for printers before, during or after they are used to print ramps or swathes.

Figure 1:
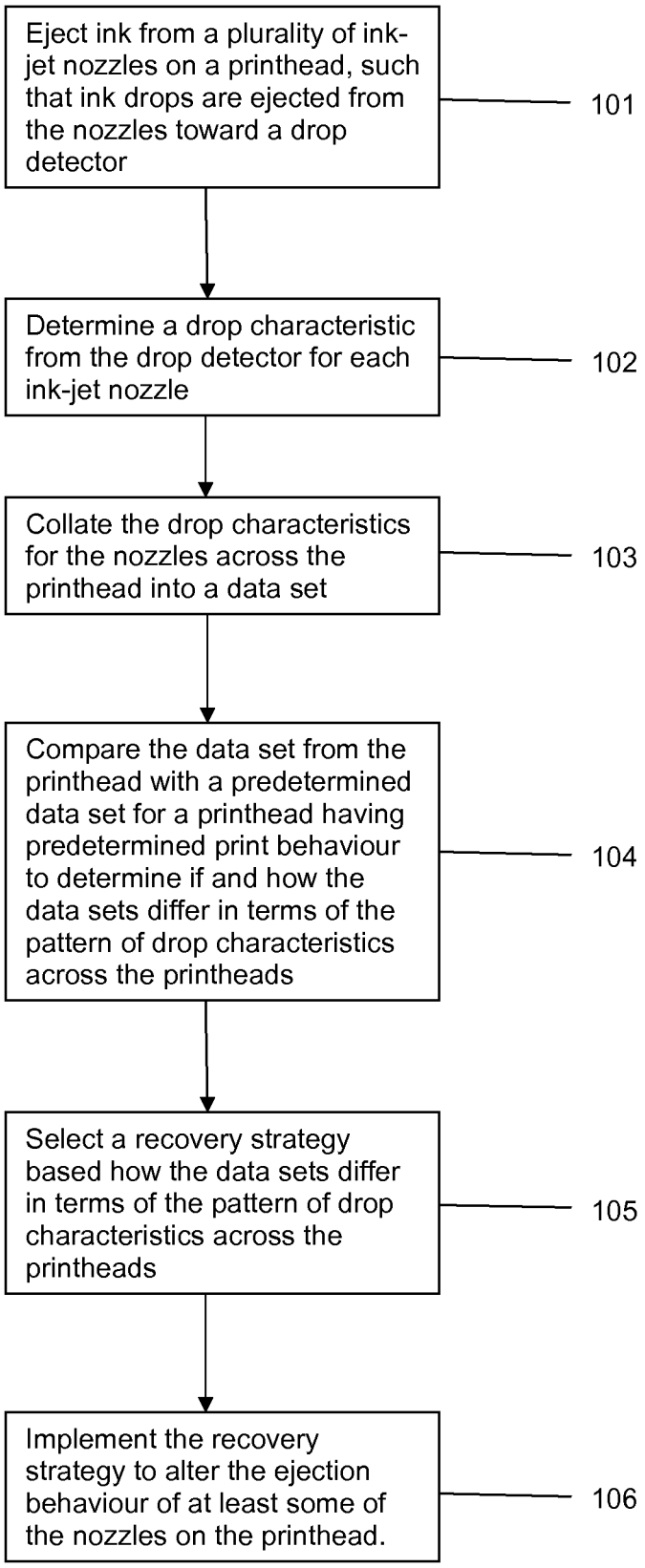
FIG. 1 shows an example of a method as described herein.

Referring now to the figures, FIG. 1 shows a flow chart for an example of a method described herein. FIG. 2 shows schematically an example of a system as described herein.

In FIG. 1, block 101 shows ejecting ink from a plurality of ink-jet nozzles on a printhead, such that ink drops are ejected from the nozzles toward a drop detector. Block 102 shows determining a drop characteristic from the drop detector for each ink-jet nozzle. Block 103 shows collating the drop characteristics for the nozzle across the printhead into a data set. Block 104 shows comparing the data set from the printhead with a predetermined data set for a printhead having predetermined print behaviour to determine if and how the data sets differ in terms of the pattern of drop characteristics across the printheads. If the data sets differ, the method involves block 105 showing selecting a recovery strategy based how the data sets differ in terms of the pattern of drop characteristics across the printheads. Block 106 shows implementing the recovery strategy to alter the ejection behaviour of at least some of the nozzles on the printhead.

The drop characteristic for each nozzle may be at least one of drop velocity, length of time from drop ejection (or a certain time point from ejection) to detection, drop size, drop shape, the rate of drops ejected per second and color of the drops.

In some examples, the comparing involves determining the proportion of nozzles of the printhead that show a drop characteristic that is different from the drop characteristic of the printhead having predetermined print behaviour. In some examples, if above a pre-determined proportion of nozzles (e.g. at least 90%, in some examples at least 95%, in some examples at least 99%) of the printhead show a drop velocity that is different from the drop velocity of the printhead having predetermined print behaviour, the printhead has its alignment adjusted as a recovery strategy to compensate for the difference in drop velocities.

In some examples, if below a pre-determined proportion (e.g. 99% or less, in some examples 95% or less, in some examples 90% or less) of nozzles of the printhead show a drop velocity that is lower than the drop velocity of the printhead having predetermined print behaviour, the energy supplied to the nozzles having this lower drop velocity is increased for the subsequent drop ejection. In some examples, after this, the ejection behaviour of the printhead is tested to determine if the drop velocity for the nozzles previously showing the lower drop velocity has been corrected.

The comparing may involve comparing a data set that is represented by a graph that plots the drop characteristics over time along the y-axis, against each nozzle along the printhead along the x-axis. The comparing may involve comparing the shape of the graph against the shape of a corresponding graph for the printhead having predetermined print behaviour. In this example, the drop characteristics may be selected from drop velocity and length of time from drop ejection (or a certain time point from ejection) to detection.

FIG. 2 shows schematically an example of a system (201) as described herein. The system may be suitable for carrying out the method described herein. The system (201) may comprises a printhead (202) having a plurality of ink-jet nozzles. The nozzles are not shown, but the flight of drops from the nozzles is shown schematically in the figure by arrows (206) emanating from the printhead (202). The system may further comprise a drop detector (202). The system may further comprise a controller (204). The controller may control the ejection of ink from the ink-jet nozzles on the printhead, such that ink drops are ejected from the plurality of nozzles toward a drop detector. The system may further comprise a processor (205). The processor (205) may collate drop characteristics from the drop detector for each nozzle across the printhead. The drop characteristics for each nozzle across the printhead may be compiled into a data set. The system, for example the processor, may compare this data set from the printhead with a predetermined data set for a printhead having predetermined print behaviour to determine if and how the data sets differ in terms of the pattern of drop characteristics across the printheads. If the data sets differ, the processor may select a recovery strategy based how the data sets differ in terms of the pattern of drop characteristics across the printheads, the processor sending a signal to the controller to implement the recovery strategy to alter the ejection behaviour of at least some of the nozzles on the printhead.

In some examples, the processor compares the data set from the printhead with a predetermined data set for a printhead having predetermined print behaviour, this involves determining the proportion of nozzles of the printhead that show a drop characteristic that is different from the drop characteristic of the printhead having predetermined print behaviour. In some examples, the processor compares data sets that plot the drop characteristics along the y-axis, against each nozzle along the printhead along the x-axis.

Figure 3:
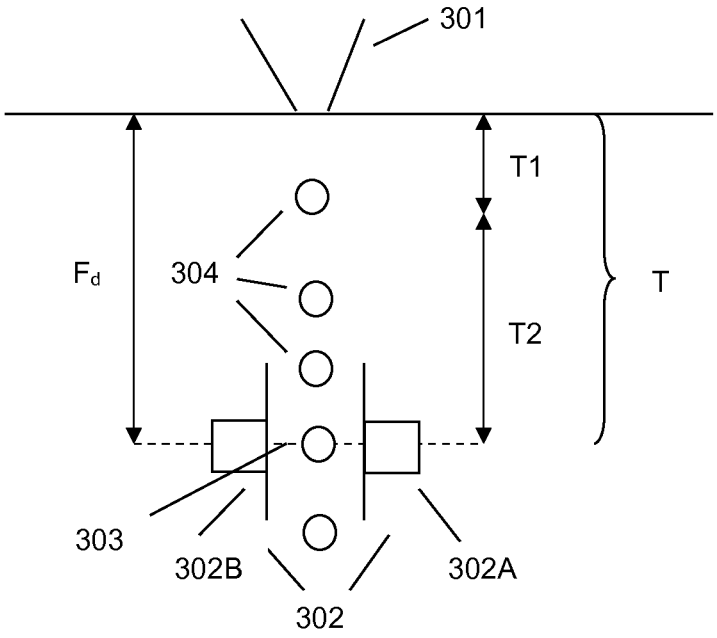
FIG. 3 shows schematically a portion of an example of a system as described herein comprising a printhead and drop detector.

FIG. 3 shows schematically a portion of an example of a system as described herein comprising a printhead and drop detector. The drop detector may be of any suitable type. This portion of the system shows schematically a nozzle (301), a drop detector unit (302), which is an optical detector comprising a detector receiver (302A) and a detector source (302B), spaced apart from the detector receiver. The detector source (302B) may emit a signal such as a light beam along a line (303) to the detector receiver (302A) to detect the presence of fluid drops (304) as they pass between the detector receiver (302A) and a detector source (302B). The drop detector may be used to determine drop velocity of drops fired from the nozzle (301) or a parameter associated with drop velocity, such as the time between the firing of the drop and the time of detection. The flight distance between the nozzle (301) and the drop detector unit (302) (or, more specifically, the line of light between detector receiver (302A) and a detector source (302B)) is typically fixed and is denoted $F_d$ in FIG. 3. The time of flight is denoted by T in FIG. 3. The time T may have two components, T1 and T2. T1 may represent a time delay from firing the drop and T2 may represent the subsequent time until the drop is detected by the drop detector unit (302). The drop velocity V may be calculated as $F_d/T$. Adjustments may be made as required to take into account any other factors, such as acceleration due to gravity.

Figure 4:
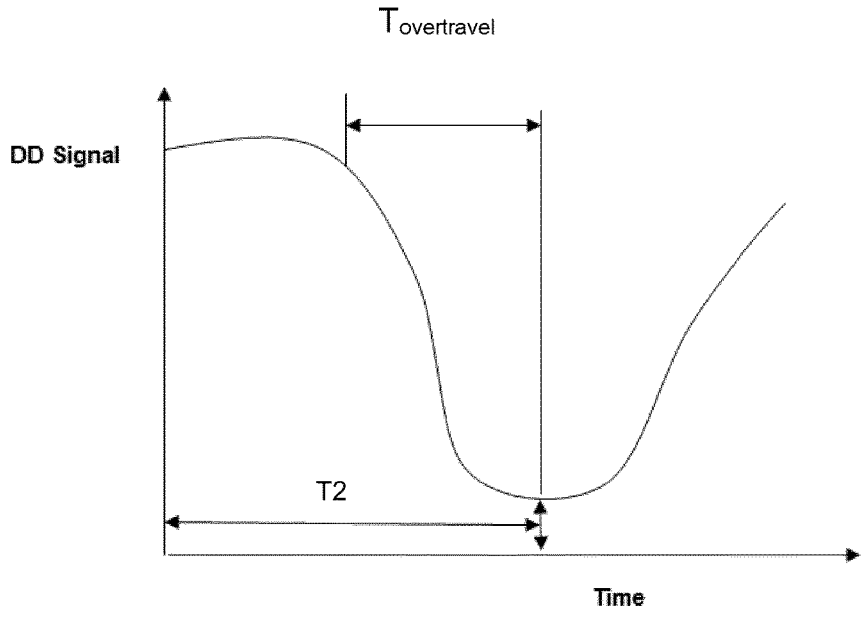
FIG. 4 shows the signal from a single unit of a drop detector as a drop passes through the detector.

FIG. 4 shows the signal from a single unit of a drop detector as a drop passes through the detector. The signal is marked DD signal on the y-axis. Time is shown on the x-axis. The time on this graph starts from the delay, immediately after the end of period T1. Initially, since no drop is present between the detector receiver (302A) and a detector source (302B), the signal is high. However, as the drop starts to pass through the light beam, the signal decreases, until it reaches its lowest point, at which point the drop is obstructing the maximum amount of light from the detector receiver (302A), i.e. can be considered to be in the centre of the light beam (i.e. in the position of the drop on the line (303) in FIG. 3. As the drop passes out of the light beam, the signal rises again. The period between the drop initially entering the light beam and the lowest point of signal may be determined $T_{overtravel}$. $T_{overtravel}$ may be used, having calculated drop velocity, to estimate the size of the drop.

In the method and system described herein, a drop detector unit may be provided for each nozzle on the printhead, so the drops fired from each nozzle can be detected. Drops may be fired simultaneously from each of the plurality of nozzles and detected by a plurality of drop detector units. In some examples, drops may be fired at different times from different nozzles, and drops from each nozzle detected by the corresponding drop detector unit.

Figure 5:
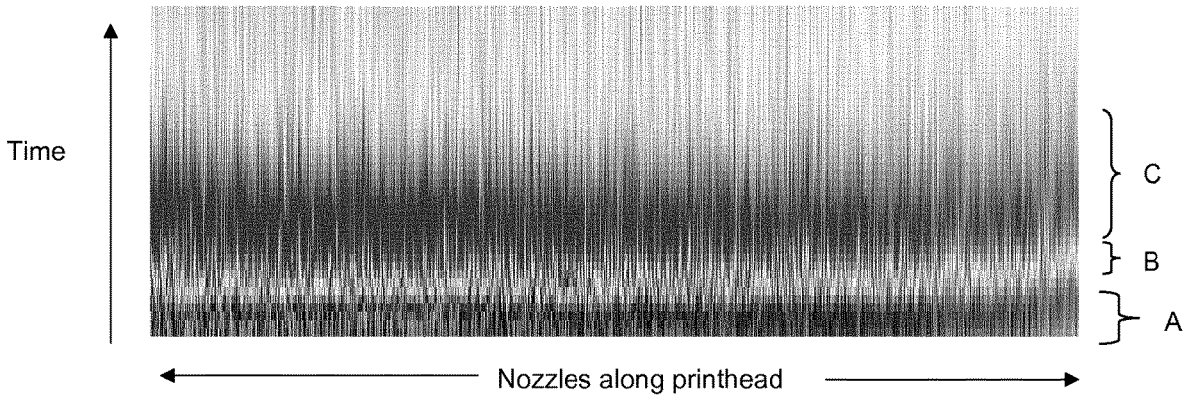
FIG. 5 shows an example of a data set collated across all nozzles of a printhead, the intensity of the signal for each nozzle being shown with time on the y-axis (time going upwards on the figure and the intensity being denoted by a colour or shade of the line). In this figure, all nozzles are firing as expected, i.e. having a drop velocity as expected and a time of reaching the drop detector as expected.

FIG. 5 shows an example of a data set collated across all nozzles of a printhead, the intensity of the signal for each nozzle being shown with time on the y-axis (time going upwards on the figure and the intensity being denoted by a colour or shade of the line). On this example printhead, there were many nozzles, e.g. at least 100. In this figure, all nozzles are firing as expected, i.e. having a drop velocity as expected and a time of reaching the drop detector as expected. Portion A represents a signal of very low intensity, i.e. for a given nozzle, a trough in FIG. 4, indicating the point at which a drop is detected. The full time from firing is not shown on this graph, the time on the y axis starting at the point at which it would be expected that a drop would be detected (if drop velocity of the nozzles is as expected). In this figure, all nozzles are firing as expected, i.e. having a drop velocity as expected and a time of reaching the drop detector as expected. This is indicated by a consistent intensity of portion A in the same time period across the printhead, indicating that all drops have approximately the same flight time, and therefore approximately same drop velocity. Portion C represents a peak in signal intensity, i.e. for a given nozzle, a point at which the intensity has risen to a maximum after a drop has been detected; portion C can be ignored for the present purposes. Portion B represents an intensity between the trough of portion A and the peak of portion C. Different signal intensities, e.g. peaks and troughs in signal intensity, may be represented by, for example, different colours or shades on a graph.

Figure 6:
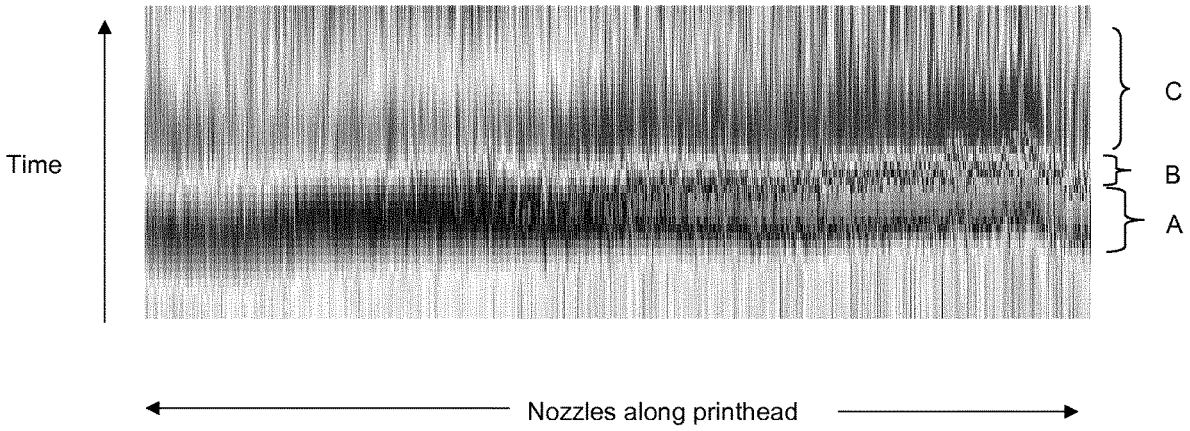
FIG. 6 shows a further example of a data set collated across all nozzles of a printhead, the intensity of the signal for each nozzle being shown with time on the y-axis (time going upwards on the figure and the intensity being denoted by a colour or shade of the line). In this figure, all nozzles across the printhead are firing with a drop velocity less than expected.

FIG. 6 shows a further example of a data set collated across all nozzles of a printhead, the intensity of the signal for each nozzle being shown with time on the y-axis (time going upwards on the figure and the intensity being denoted by a colour or shade of the line). All nozzles across the printhead are firing with a drop velocity less than expected. In this data set, the time on the Y axis starts at about the same point as the graph in data set in FIG. 5 (i.e. from approximately the same time delay after firing). The portion A of low signal intensity occurs at a later time for all nozzles compared to the graph in FIG. 5. However, the area of low signal intensity A for each nozzle occurs approximately at the same time. Accordingly, this is indicative that approximately all nozzles have a lower drop velocity than the drops detected in FIG. 5, although all drops in FIG. 6 have about the same drop velocity.

Figure 7:
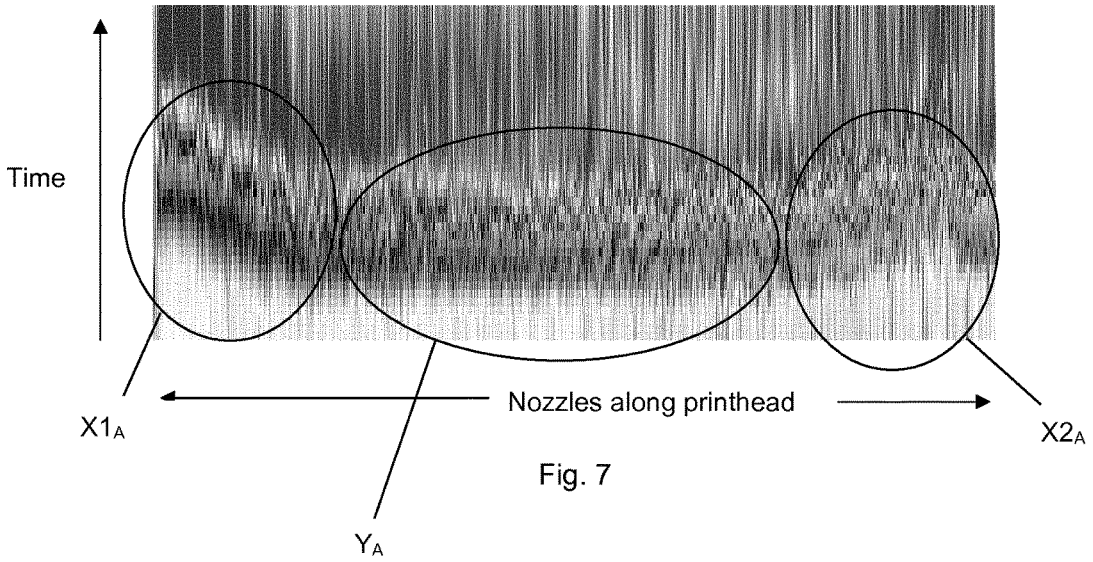
FIG. 7 shows a further example of a data set collated across all nozzles of a printhead, the intensity of the signal for each nozzle being shown with time on the y-axis (time going upwards on the figure and the intensity being denoted by a colour or shade of the line). In this figure, the nozzles toward each end of the printhead are firing with a drop velocity less than expected, with the nozzles toward the centre of the printhead firing with a more expected drop velocity.

FIG. 7 shows a further example of a data set collated across all nozzles of a printhead, the intensity of the signal for each nozzle being shown with time on the y-axis (time going upwards on the figure and the intensity being denoted by a colour or shade of the line). In this data set, the time on the Y axis starts a bit earlier than the graph in data set in FIG. 5 (i.e. from approximately the same time delay after firing). In this figure, the nozzles toward each end of the printhead are firing with a drop velocity less than expected, with the nozzles toward the centre of the printhead firing with a more expected drop velocity. Areas of low signal intensity toward the ends of the printhead are denoted by $X1_A$ and $X2_A$. As can be seen, the flight time for the nozzles increases gradually toward each end of the printhead, the nozzles closest to each end of the left hand side of the printhead having the longest flight time, and therefore the slowest drop velocity. The nozzles that give the results in section $Y_A$ have approximately the same flight time as one another, and therefore approximately the same drop velocity as one another.

Figure 8:
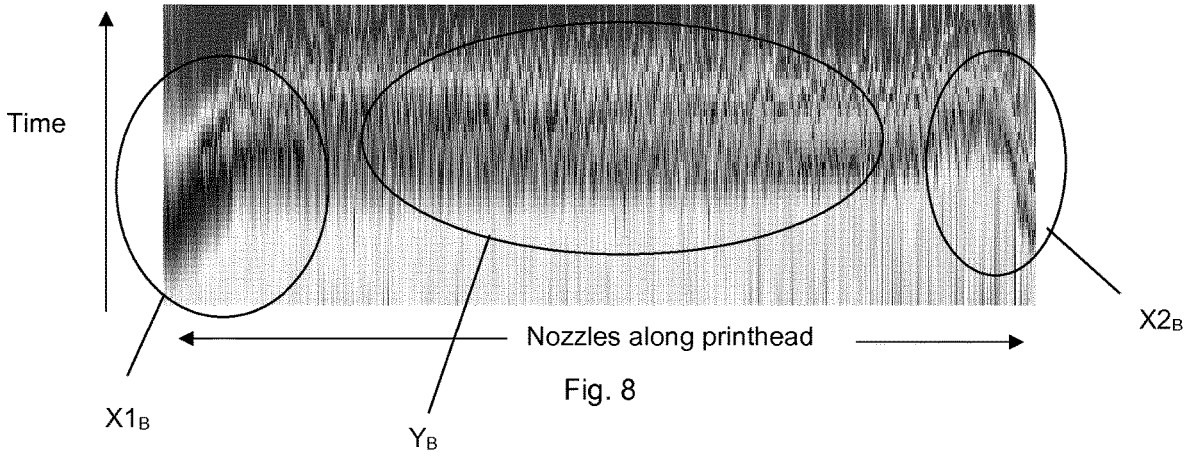
FIG. 8 shows a further example of a data set collated across all nozzles of a printhead, the intensity of the signal for each nozzle being shown with time on the y-axis (time going upwards on the figure and the intensity being denoted by a colour or shade of the line). In this figure, the nozzles toward the centre of the printhead are firing with a drop velocity less than expected, with the nozzles toward each end of the centre of the printhead firing with a more expected drop velocity.

FIG. 8 shows a further example of a data set collated across all nozzles of a printhead, the intensity of the signal for each nozzle being shown with time on the y-axis (time going upwards on the figure and the intensity being denoted by a colour or shade of the line). In this figure, the nozzles toward the centre of the printhead are firing with a drop velocity less than expected, with the nozzles toward each end of the printhead firing with a more-expected drop velocity. Areas of low signal intensity toward the ends of the printhead are denoted by $X1_B$ and $X2_B$. As can be seen, the flight time for the nozzles decreases gradually toward each end of the printhead, the nozzles closest to each end of the left hand side of the printhead having the shortest flight time, and therefore the highest drop velocity (close to an expected value if no kogation or other firing difficulty with the nozzle is assumed). The nozzles that give the results in section $Y_B$ have approximately the same flight time as one another, and therefore approximately the same drop velocity as one another. The nozzles in area $Y_B$ are firing with a lower drop velocity than expected.

The print behaviour of a printhead is different in each of the cases above, e.g. when printing a line across a page using all nozzles. For a printhead showing the pattern of drop velocities in FIG. 5, the printer will typically print a line where expected on a print substrate and the line will be straight across the page. For a printhead showing the pattern of drop velocities in FIG. 6, the printer may print a line, which is straight across the page, but its location will be shifted from the expected position. For a printhead showing the pattern of drop velocities in FIG. 7, the printer may print a line, which is straight in its middle portion, this middle portion being approximately where expected, but the line will bend towards each end away from the expected location, reflecting the slower drop velocity. For a printhead showing the pattern of drop velocities in FIG. 7, the printer will typically print a line, which is straight in its middle portion, this middle portion, however being shifted from its expected location, but the line will bend towards each end toward the expected location of the line. The above print results will be more pronounced in bi-directional printing, where a printhead is moved in one direction (e.g. up a page) to print an image and then in the reverse direction to print the image (e.g. down a page). Here, if a line is printed when the printhead is moving in each direction, and all nozzles are firing with expected drop velocities, the two lines of drops on the page will be straight and printed one on top of the other, so only a single line is seen. This would be the print pattern when printing a line across a page with the printhead showing the pattern of drop velocities in FIG. 5. When printing a line across a page in a bi-directional manner using the printhead showing the pattern of drop velocities in FIG. 6, two lines of drops will be deposited on the page, spaced apart from one another. When printing a line across a page in a bi-directional manner using the printhead showing the pattern of drop velocities in FIG. 7, the end result is a line having straight middle portion (formed from two lines of drops deposited in the same locations across the page in this portion), with each the end of the line splitting into two diverging lines. When printing a line across a page in a bi-directional manner using the printhead showing the pattern of drop velocities in FIG. 8, the end result is a line having two straight end portions (formed from two lines of drops deposited in the same locations across the page in these portions), with a blurred middle portions, formed from drops fired from nozzles toward the centre of the printhead that have lower-than-expected drop velocities.

If a printhead is not firing all nozzles as expected, e.g. not firing all nozzles with the same, expected drop velocity, different recovery strategies may be more appropriate than others for different types of print behaviour. For example, it has been found that when all or nearly all of the nozzles are firing with the same, but unexpected, drop velocity, i.e. less or more than an expected, pre-determined value, this can be corrected with an adjustment of the alignment of the printhead. However, when some nozzles on the printhead are showing differing print behaviour, e.g. some showing expected drop velocity and others showing higher- or lower-than-expected drop velocity, adjusting the alignment of the whole printhead may not be so appropriate or effective. In that instance, it has been found to be more effective to alter the energy supplied to the nozzles that are showing higher- or lower-than-expected drop velocity. For those nozzles showing lower-than-expected drop velocity, a higher energy than before may supplied to eject the drops, such that they eject with a higher drop velocity. In some examples, the energy supplied may be for a period so as to clean the nozzles from any deposits resulting from kogation, and the drops then fired with the previous (lower) energy, in some examples to the drop detector to see if this has effected a correction in the drop velocity.

Figure 9:
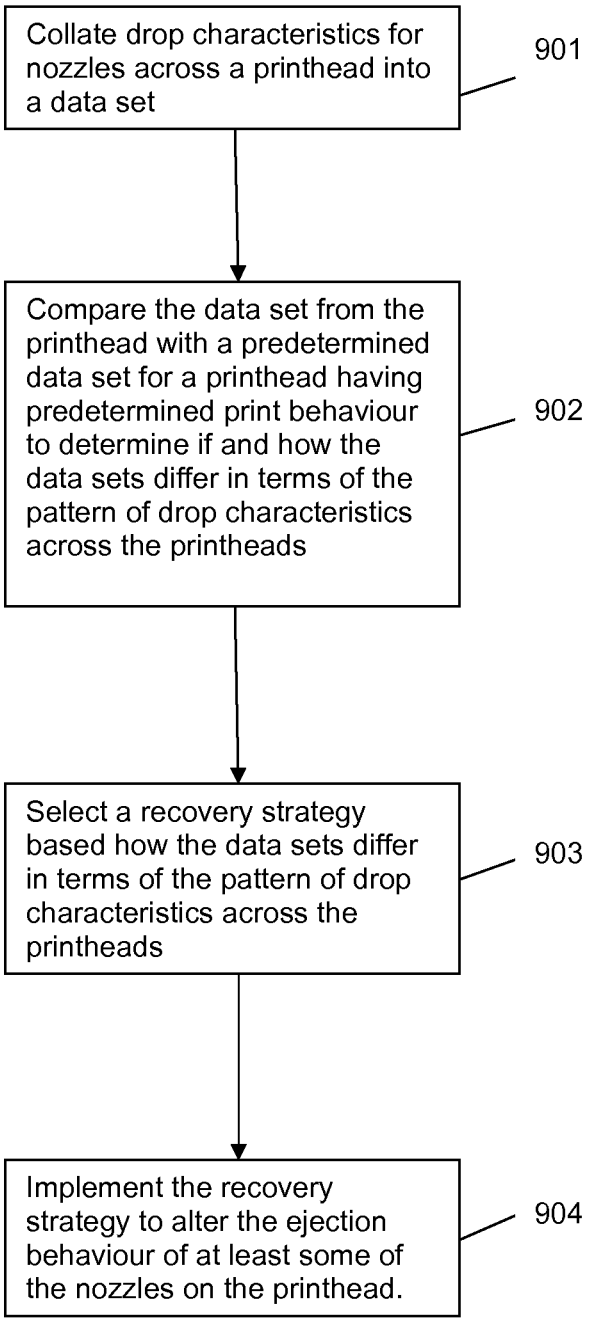
FIG. 9 shows an example of instructions that may be stored on an example of a computer readable medium described herein.

Also provided is a computer readable medium having instructions stored thereon that, if executed by a processor, cause the processor and any associated components, which may be selected from a drop detector, a printhead and a controller, to carry out at least part of the method described herein. An example of the instructions is shown in FIG. 9. As shown in block 901, the instructions may cause the processor to collate drop characteristics for nozzles across a printhead into a data set. The drop characteristics may be from ejecting ink from a plurality of ink-jet nozzles on the printhead, such that ink drops are ejected from the nozzles toward a drop detector. Drop characteristics from the drop detector may be determined for each ink-jet nozzle. As shown in block 902, the processor may then compare the data set from the printhead with a predetermined data set for a printhead having predetermined print behaviour to determine if and how the data sets differ in terms of the pattern of drop characteristics across the printheads. As shown in block 903, if the data sets differ, the processor may select a recovery strategy based how the data sets differ in terms of the pattern of drop characteristics across the printheads. As shown in block 904, the process may implement the recovery strategy to alter the ejection behaviour of at least some of the nozzles on the printhead. The computer readable medium may be a non-transitory computer readable medium. The computer readable medium may comprise a memory, which may be selected from a volatile memory, a non-volatile memory, and a storage device. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM). Examples of storage devices include, but are not limited to, hard disk drives, compact disc drives, digital versatile disc drives, optical drives, and flash memory devices.

The invention claimed is:

1. A method comprising:

ejecting ink from a plurality of ink-jet nozzles on a printhead, such that ink drops are ejected from the nozzles toward a drop detector;

determining a drop characteristic from the drop detector for each ink-jet nozzle;

collating the drop characteristics for the nozzles across the printhead into a data set;

comparing the data set from the printhead with a predetermined data set for a printhead having predetermined print behaviour to determine if and how the data sets differ in terms of the pattern of drop characteristics across the printheads; and, if the data sets differ, selecting a recovery strategy based how the data sets differ in terms of the pattern of drop characteristics across the printheads; and implementing the recovery strategy to alter the ejection behaviour of at least some of the nozzles on the printhead.

2. The method according to claim 1, wherein the drop characteristic for each ink-jet nozzle is at least one of drop velocity, length of time from drop ejection to detection, drop size, drop shape, the rate of drops ejected per second and color of the drops.

3. The method according to claim 1, wherein the comparing involves determining the proportion of nozzles of the printhead that shows a drop characteristic that is different from the drop characteristic of the printhead having predetermined print behaviour.

4. The method according to claim 3, wherein, if above a pre-determined proportion of nozzles of the printhead shows a drop velocity that is different from the drop velocity of the printhead having predetermined print behaviour, the printhead has its alignment adjusted as a recovery strategy to compensate for the difference in drop velocities.

5. The method according to claim 3, wherein if below a pre-determined proportion of nozzles of the printhead show a drop velocity that is lower than the drop velocity of the printhead having predetermined print behaviour, the energy supplied to the nozzles having this lower drop velocity is increased for the subsequent drop ejection.

6. The method according to claim 5, wherein the ejection behaviour of the printhead is tested to determine if the drop velocity for the nozzles previously showing the lower drop velocity has been corrected.

7. The method according to claim 5, wherein the increased energy is supplied only for a specific period of time so as to clean the nozzles.

8. The method according to claim 1, wherein the comparing involves comparing a data set represented by a graph that plots the drop characteristics over time along the y-axis, against each nozzle along the printhead along the x-axis.

9. The method according to claim 8, wherein the comparing involves comparing the shape of the graph against the shape of a corresponding graph for the printhead having predetermined print behaviour.

10. The method according to claim 8, wherein the drop characteristic for each nozzle is selected from drop velocity and length of time from drop ejection (or a certain time point from ejection) to detection.

11. A system comprising:

a printhead having a plurality of ink-jet nozzles, a drop detector, a controller to control the ejection of ink from the ink-jet nozzles on the printhead, such that ink drops are ejected from the plurality of nozzles toward a drop detector, and a processor to (i) collate drop characteristics from the drop detector for nozzles across the printhead into a data set, and (ii) compare the data set from the printhead with a predetermined data set for a printhead having predetermined print behaviour to determine if and how the data sets differ in terms of the pattern of drop characteristics across the printheads; and (iii), if the data sets differ, the processor selects a recovery strategy based how the data sets differ in terms of the pattern of drop characteristics across the printheads, the processor sending a signal to the controller to implement the recovery strategy to alter the ejection behaviour of at least some of the nozzles on the printhead.

12. The system according to claim 11, wherein the drop characteristic for each nozzle is at least one of drop velocity, length of time from drop ejection to detection, drop size, drop shape, the rate of drops ejected per second and color of the drops.

13. The system according to claim 11, when the processor compares the data set from the printhead with a predetermined data set for a printhead having predetermined print behaviour, this involves determining the proportion of nozzles of the printhead that show a drop characteristic that is different from the drop characteristic of the printhead having predetermined print behaviour.

14. The system according to claim 13, wherein, if above a pre-determined proportion of nozzles of the printhead show a drop velocity that is different from the drop velocity of the printhead having predetermined print behaviour, the processor sends a signal to the controller to implement the recovery strategy, which comprises adjusting the alignment of the printhead to compensate for the difference in drop velocities.

15. The system according to claim 13, wherein if below a pre-determined proportion of nozzles of the printhead show a drop velocity that is lower than the drop velocity of the printhead having predetermined print behaviour, the energy supplied to the nozzles having this lower drop velocity is increased for the subsequent drop ejection.

16. The system according to claim 15, wherein the increased energy is supplied only for a specific period of time so as to clean the nozzles.

17. A computer readable medium having instructions stored thereon that, if executed by a processor, cause the processor to:

collate drop characteristics for nozzles across a printhead into a data set;

compare the data set from the printhead with a predetermined data set for a printhead having predetermined print behaviour to determine if and how the data sets differ in terms of the pattern of drop characteristics across the printheads; and, if the data sets differ, select a recovery strategy based how the data sets differ in terms of the pattern of drop characteristics across the printheads; and implement the recovery strategy to alter the ejection behaviour of at least some of the nozzles on the printhead.

18. The computer readable medium according to claim 17, wherein the comparing involves determining the proportion of nozzles of the printhead that shows a drop characteristic that is different from the drop characteristic of the printhead having predetermined print behaviour.

19. The computer readable medium according to claim 18, wherein, if above a pre-determined proportion of nozzles of the printhead shows a drop velocity that is different from the drop velocity of the printhead having predetermined print behaviour, the printhead has its alignment adjusted as a recovery strategy to compensate for the difference in drop velocities.

20. The computer readable medium according to claim 18, wherein if below a pre-determined proportion of nozzles of the printhead show a drop velocity that is lower than the drop velocity of the printhead having predetermined print behaviour, the energy supplied to the nozzles having this lower drop velocity is increased for the subsequent drop ejection.

* * * * *